US009852839B2

(12) United States Patent
Takagi et al.

(10) Patent No.: US 9,852,839 B2
(45) **Date of Patent: *Dec. 26, 2017**

(54) COIL COMPONENT AND MANUFACTURING METHOD THEREOF

(71) Applicant: TDK Corporation, Tokyo (JP)

(72) Inventors: Nobuo Takagi, Tokyo (JP); Tasuku Mikogami, Tokyo (JP); Setu Tsuchida, Yamagata (JP); Hiroyuki Abe, Yamagata (JP)

(73) Assignee: TDK CORPORATION, Tokyo (JP)

( * ) Notice: Subject to any disclaimer, the term of this patent is extended or adjusted under 35 U.S.C. 154(b) by 230 days.

This patent is subject to a terminal disclaimer.

(21) Appl. No.: 14/719,788

(22) Filed: May 22, 2015

(65) Prior Publication Data

US 2016/0133377 A1 May 12, 2016

(30) Foreign Application Priority Data

Jun. 5, 2014 (JP) ..... 2014-116531

(51) Int. Cl.

| | |
|---|---|
| ***H01F 27/02*** | (2006.01) |
| ***H01F 27/28*** | (2006.01) |
| ***H01F 41/066*** | (2016.01) |
| ***H01F 27/29*** | (2006.01) |
| ***H01F 17/04*** | (2006.01) |
| ***H01F 27/32*** | (2006.01) |
| ***H01F 41/12*** | (2006.01) |
| *H01F 17/00* | (2006.01) |

(52) U.S. Cl.

CPC ..... *H01F 27/2823* (2013.01); *H01F 17/045* (2013.01); *H01F 27/02* (2013.01); *H01F 27/29* (2013.01); *H01F 27/327* (2013.01); *H01F 41/066* (2016.01); *H01F 41/127* (2013.01); *H01F 2017/0093* (2013.01)

(58) Field of Classification Search

CPC ..... H01F 27/00–27/30
USPC ..... 336/65, 83, 90, 92, 96, 192, 200, 232
See application file for complete search history.

(56) References Cited

U.S. PATENT DOCUMENTS

| | | | | |
|---|---|---|---|---|
| 3,308,414 A * | 3/1967 | Ostrander | ..... | H01B 3/085 174/110 R |
| 6,144,280 A * | 11/2000 | Amada | ..... | H01F 17/045 29/602.1 |
| 6,348,850 B1 * | 2/2002 | Kimura | ..... | H01F 17/045 336/200 |
| 6,373,366 B1 * | 4/2002 | Sato | ..... | H01F 17/045 336/192 |
| 6,965,289 B2 * | 11/2005 | Toi | ..... | H01F 27/365 336/200 |

(Continued)

FOREIGN PATENT DOCUMENTS

JP 2012-119568 A 6/2012

*Primary Examiner* — Tuyen Nguyen
(74) *Attorney, Agent, or Firm* — Young Law Firm, P.C.

(57) ABSTRACT

Disclosed herein is a coil component that includes: a drum core that includes first and second flange portions having wire connection portions and a winding core portion located between the first and second flange portions; a coated conductive wire that is wound around the winding core portion, each end of the coated conductive wire being connected to respective one of the wire connection portions; and a resin coating layer that covers at least the coated conductive wire located in a first layer in the winding core portion.

12 Claims, 8 Drawing Sheets

(56) References Cited

U.S. PATENT DOCUMENTS

| | | | | |
|---|---|---|---|---|
| 7,791,444 | B2 * | 9/2010 | Tomonari | H01F 19/04 336/192 |
| 7,898,375 | B2 * | 3/2011 | Kitajima | H01F 17/045 336/185 |
| 8,438,720 | B2 * | 5/2013 | Muneuchi | H01F 17/045 29/602.1 |
| 2002/0067232 | A1 | 6/2002 | Oshima et al. | |
| 2008/0309445 | A1 | 12/2008 | Suzuki et al. | |
| 2009/0219127 | A1 | 9/2009 | Tomonari et al. | |
| 2010/0219924 | A1 | 9/2010 | Wu et al. | |

* cited by examiner

COIL COMPONENT AND MANUFACTURING METHOD THEREOF

BACKGROUND OF THE INVENTION

Field of the Invention

The present invention relates to a coil component and a manufacturing method of the coil component, and particularly to a coil component that uses a drum core and a manufacturing method thereof.

Description of Related Art

In recent years, electronic components that are used in information terminal devices such as smartphones have been strongly required to be smaller in size and lower in height. Therefore, as for coil components such as pulse transformers, surface-mount coil components that use drum cores instead of toroidal cores have been frequently used. For example, Japanese Patent Application Laid-Open No. 2012-119568 discloses a step-up transformer of a surface-mount type that uses a drum core.

The coil components that use drum cores have been required to be even smaller in size and lower in height. The size of a winding core portion has been decreasing from year to year. In order to secure a required inductance, a coated conductive wire that is thinner in diameter needs to be used.

However, the coated conductive wire that is thin in diameter is low in dielectric strength voltage. Accordingly, coil components that need to insulate primary and secondary windings, such as pulse transformers, may be insufficient in dielectric strength voltage. In particular, if wires are connected to terminal electrodes by thereto-compression bonding or laser bonding, heat that is applied at the time of wire connection is conveyed via core material of the coated conductive wire, and the coating film would be degraded. Therefore, the problem is that the component is likely to be insufficient in dielectric strength voltage.

SUMMARY

It is therefore an object of the present invention to provide a coil component that is high in dielectric strength voltage even when a coated conductive wire that is thin in diameter is used, and a manufacturing method of the coil component.

A coil component of the present invention includes: a drum core that includes first and second flange portions having wire connection portions and a winding core portion located between the first and second flange portions; a coated conductive wire that is wound around the winding core portion, each end of the coated conductive wire being connected to respective one of the wire connection portions; and a resin coating layer that covers at least the coated conductive wire located in a first layer in the winding core portion.

According to the present invention, the resin coating layer covers the first-layer constituted of the coated conductive wire that is likely to be insufficient in dielectric strength voltage. Therefore, it is possible to improve the dielectric strength voltage.

In the case of the present invention, the coated conductive wire preferably includes a primary winding and secondary winding that are insulated from each other. The reason is that a higher dielectric strength voltage is frequently required for this kind of coil component.

The coil component of the present invention preferably further includes a plate core that is bonded to the first and second flange portions. According to this configuration, a closed magnetic circuit is formed by the drum core and the plate core. Thus, it is possible to enhance the magnetic properties.

In this case, between the first and second flange portions and the plate-like core, the resin coating layer preferably does not exist. According to this configuration, the gap between the drum core and the plate-like core does not widen due to the existence of the resin coating layer. Thus, it is possible to further enhance the magnetic properties.

In the case of the present invention, the wire connection portion is preferably not covered with the resin coating layer. According to this configuration, it is possible to prevent a connection failure associated with the resin coating layer, a drop in solder wettability, and the like.

In the case of the present invention, at least part of a cross section of the winding core portion that is perpendicular to an axis direction is preferably arc-shaped. According to this configuration, it is possible to further ensure that the resin coating layer covers reliably the first-layer constituted of the coated conductive wire compared with cases where a winding core portion that is rectangular in cross-section is used.

A manufacturing method of a coil component according to the present invention includes: winding, around a winding core portion of a drum core, a coated conductive wire including a core material, a coating film that covers the core material, and a resin film that covers the coating film; connecting both ends of the coated conductive wire to wire connection portions that are provided in first and second flange portions of the drum core; and forming a resin coating layer to cover at least the coated conductive wire that is located in a first layer in the winding core portion by melting the resin film.

According to the present invention, the resin coating layer is formed as the resin film covering the coating film melts. Therefore, it is possible to improve the dielectric strength voltage. Moreover, there is no need to coat with resin material or the like after the coated conductive wire is wound. Therefore, the number of steps does not increase.

According to the present invention, the connecting is preferably carried out by thermo-compression bonding or laser bonding. The reason is that, if the wire is connected by thermo-compression bonding or laser bonding, the dielectric strength voltage tends to become insufficient due to the heat applied at the time of the wire connection.

In this case, the coated conductive wires preferably include a first coated conductive wire that is located in the first layer in the winding core portion and a second coated conductive wire that is located in a second or subsequent layer in the winding core portion, and the connecting includes a step of connecting the first coated conductive wire to the wire connection portion and then the second coated conductive wire to the wire connection portion. The reason is that, if the wire connection work is carried out multiple times on the same wire connection portions as described above, the effects of the heat become more significant.

The method of producing the coil component of the present invention preferably further includes bonding a plate core to the first and second flange portions, wherein the resin film melts due to heat applied at the bonding step. According to this method, the step of bonding the plate-like core and the step of melting the resin film can be performed at the same time.

According to the present invention, it is possible to provide a coil component that is high in dielectric strength voltage even when a coated conductive wire that is thin in diameter is used, and a manufacturing method of the coil component.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
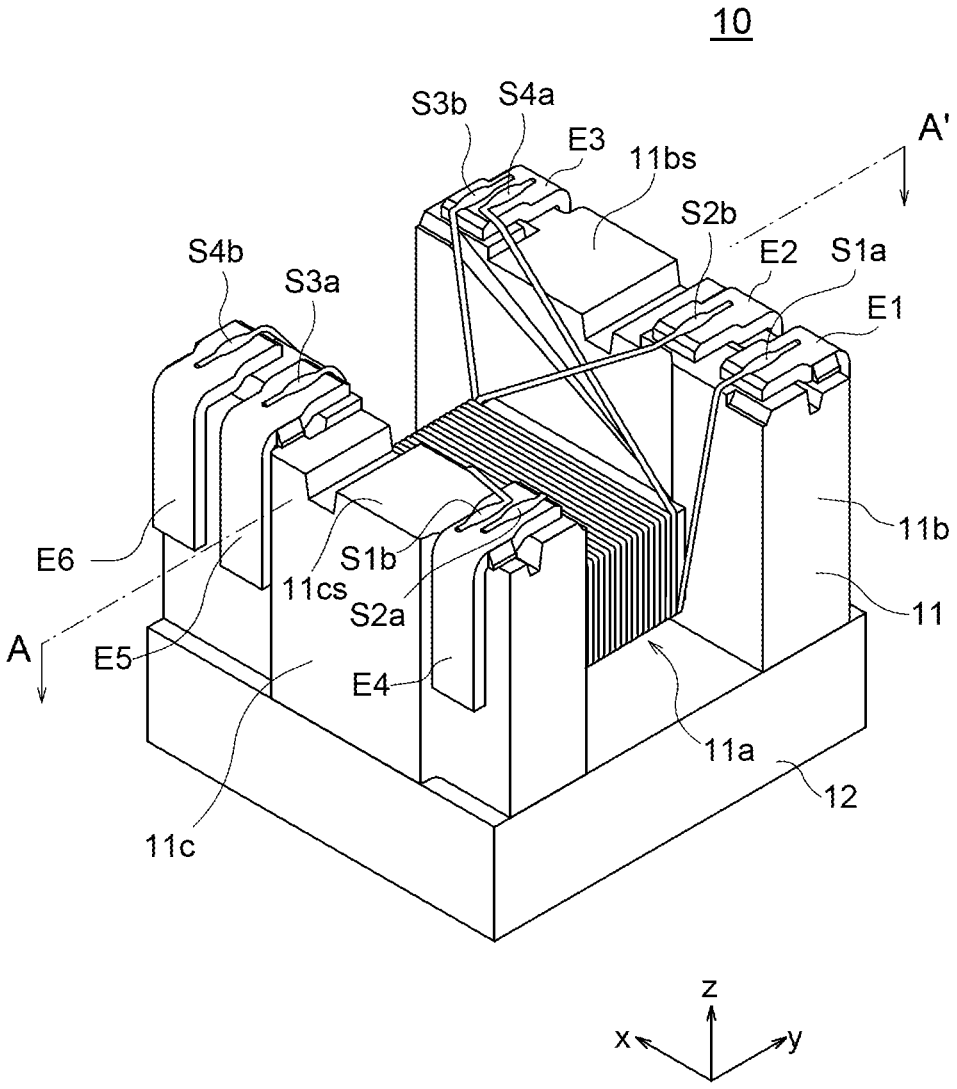
FIG. 1 is a schematic perspective view showing the appearance structure of a coil component according to a first embodiment of the present invention.

FIG. 1 is a schematic perspective view showing the appearance structure of a coil component 10 according to the first embodiment of the present invention.

The coil component 10 of the present embodiment is a pulse transformer of a surface-mount type. As shown in FIG. 1, the coil component 10 includes a drum core 11, a plate core 12 that is bonded to the drum core 11, and coated conductive wires S1 to S4 that are wound around a winding core portion 11*a* of the drum core 11. The coil component of the present invention is not limited to the pulse transformer. The coil component of the present invention may be any other transformer component such as a balun transformer or step-up transformer, or may be a filter component such as a common mode choke coil.

The drum core 11 and the plate core 12 are made of a magnetic material that is relatively high in magnetic permeability such as a sintered composite of Ni—Zn ferrite or Mn—Zn ferrite, for example. Incidentally, the magnetic material that is high in magnetic permeability such as Mn—Zn ferrite is usually low in specific resistance and electrically conductive.

The drum core 11 includes the rod-shaped winding core portion 11*a*, and first and second flange portions 11*b* and 11*c* that are provided at both ends in y-direction of the winding core portion 11*a*. The winding core portion 11*a* and flange portions 11*b* and 11*c* are integrally formed. The coil component 10 is a component that is mounted on a surface of a printed circuit board at the time of actual use. The coil component 10 is mounted in such a way that z-direction upper surfaces 11*bs* and 11*cs* of the flange portions 11*b* and 11*c* face the printed circuit board. To the opposite sides, or lower surfaces, of the flange portions 11*b* and 11*c* from the upper surfaces 11*bs* and 11*cs*, the plate core 12 is bonded with an adhesive. According to this structure, a closed magnetic circuit is formed by the drum core 11 and the plate core 12.

On the upper surface 11*bs* of the first flange portion 11*b*, three wire connection portions E1 to E3 that serve as terminal electrodes are provided. On the upper surface 11*cs* of the second flange portion 11*c*, three wire connection portions E4 to E6 that serve as terminal electrodes are provided. The wire connection portions E1 to E6 include L-shaped terminal metal fittings that are attached to the corresponding flange portions 11*b* and 11*c*. However, the terminal metal fittings are not necessarily required to be used. The wire connection portions E1 to E6 may be formed by conductor film that is burned into the surfaces of the corresponding flange portions 11*b* and 11*c*. The wire connection portions E1 to E3 are arranged in this order from one end side in x-direction as shown in FIG. 1. Similarly, the wire connection portions E4 to E6 are arranged in this order from one end side in x-direction. Ends of the coated conductive wires S1 to S4 are connected to the wire connection portions E1 to E6 by thermo-compression bonding or laser bonding.

As shown in FIG. 1, the distance between the wire connection portions E2 and E3 is designed in such a way as to be greater than the distance between the wire connection portions E1 and E2. Similarly, the distance between the wire connection portions E4 and E5 is designed in such a way as to be greater than the distance between the wire connection portions E5 and E6. This configuration is intended to improve the withstand voltage between a primary winding that is formed by the coated conductive wires S1 and S2 and a secondary winding that is formed by the coated conductive wires S3 and S4.

The coated conductive wires S1 to S4 include a core material (metal core) that is made of a good conductor, and an insulating coating film that covers the core material. The coated conductive wires S1 to S4 are wound around the winding core portion 11*a* in a double-layered structure. While the details will be described later, the coated conductive wires S1 and S4 are wound around the winding core portion 11*a* in a bifilar winding pattern in order to form a first layer, and the coated conductive wires S2 and S3 are wound around the winding core portion 11*a* in a bifilar winding pattern in order to form a second layer. The numbers of turns of the coated conductive wires S1 to S4 may be equal.

The winding direction of the coated conductive wires S1 to S4 is different between the first and second layers. When the winding direction from the first flange portion 11*b* to the second flange portion 11*c* is seen from the flange portion 11*b*'s side, the winding direction of the coated conductive wires S1 and S4 is counterclockwise, and the winding direction of the coated conductive wires S2 and S3 is clockwise. In this manner, the winding direction of the coated conductive wires S1 and S4 is opposite to the winding direction of the coated conductive wires S2 and S3.

One end S1*a* and the other end S1*b* of the coated conductive wire S1 are connected to the wire connection portions E1 and E4, respectively. One end S4*a* and the other end S4*b* of the coated conductive wire S4 are connected to the wire connection portions E3 and E6, respectively. One end S2*a* and the other end S2*b* of the coated conductive wire S2 are connected to the wire connection portions E4 and E2, respectively. One end S1*a* and the other end S3*b* of the coated conductive wire S3 are connected to the wire connection portions E5 and E3, respectively.

Figure 2:
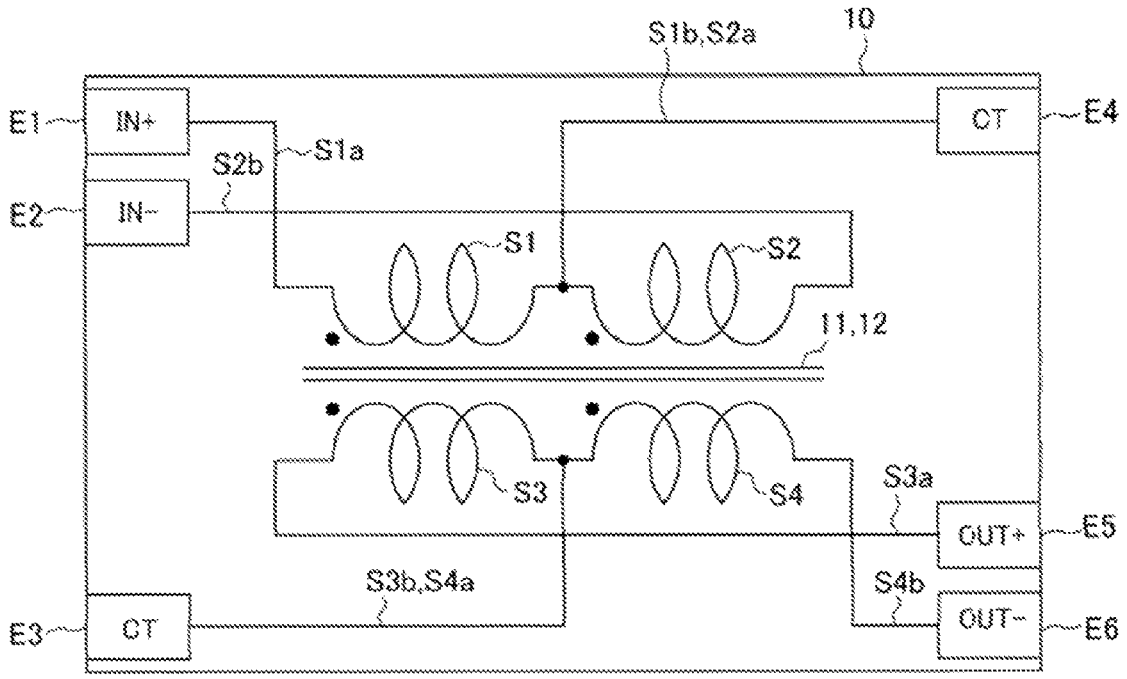
FIG. 2 shows an equivalent circuit of the coil component shown in FIG. 1.

FIG. 2 shows an equivalent circuit of the coil component 10 according to the present embodiment.

As shown in FIG. 2, the wire connection portions E1 and E2 are used as balanced-input positive terminal IN+ and negative terminal IN−, respectively. The wire connection portions E5 and E6 are used as balanced-output positive terminal OUT+ and negative terminal OUT−, respectively. The wire connection portions E3 and E4 are used as output-side center tap CT and input-side center tap CT, respectively. The coated conductive wires S1 and S2 constitute the primary winding of the pulse transfer. The coated conductive wires S3 and S4 constitute the secondary winding of the pulse transfer.

Figure 3:
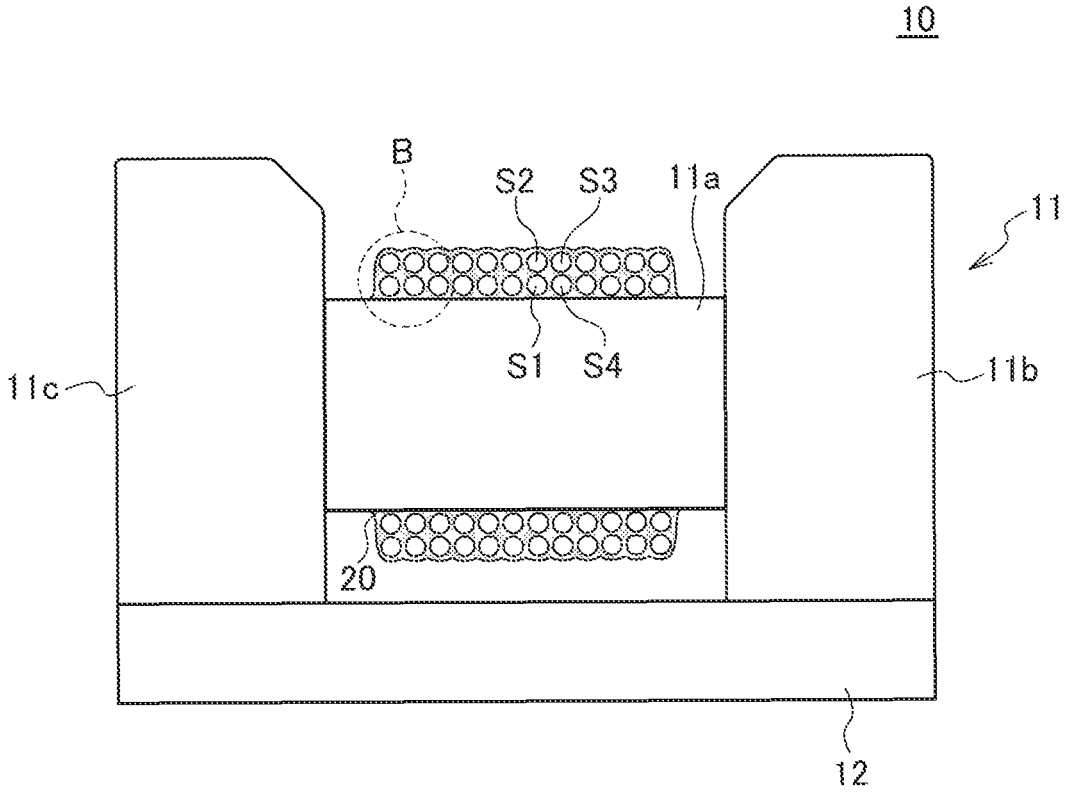
FIG. 3 is a cross-sectional view taken along line A-A' shown in FIG. 1.
Figure 4:
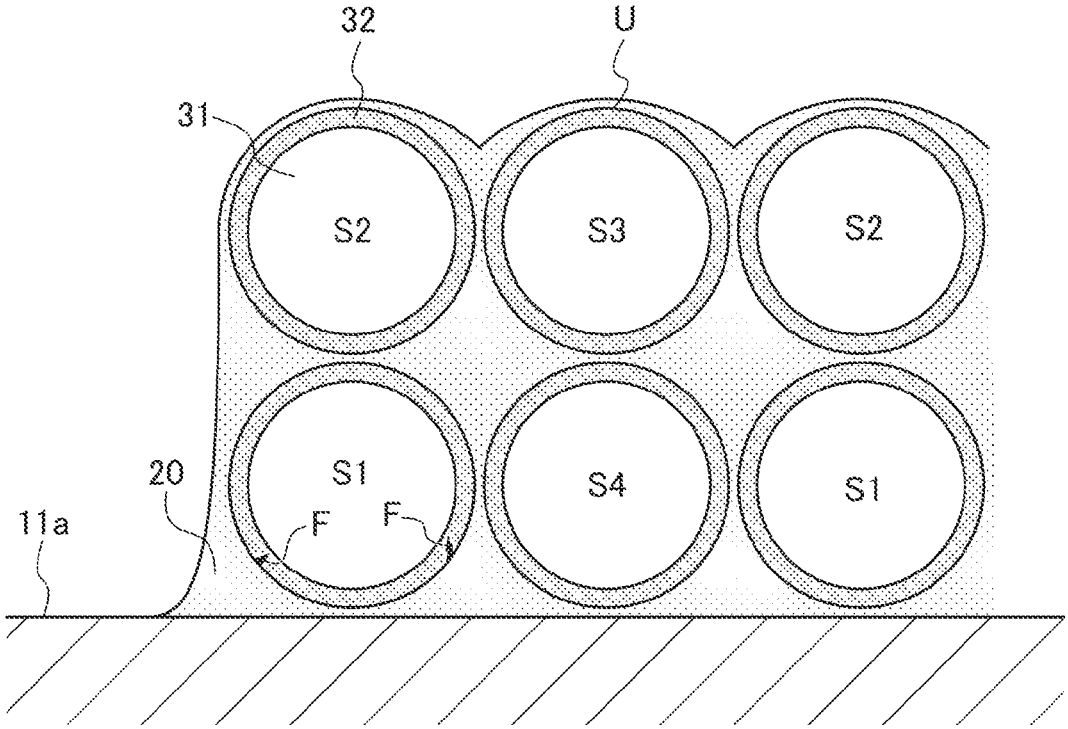
FIG. 4 is an enlarged view of an area B shown in FIG. 3.

FIG. 3 is a cross-sectional view taken along line A-A' shown in FIG. 1. FIG. 4 is an enlarged view of an area B shown in FIG. 3.

As shown in FIGS. 3 and 4, the coated conductive wires S1 and S4 are wound as the first layer on the winding core portion 11*a* of the drum core 11. The coated conductive wires S2 and S3 are wound as the second layer on the first layer. That is, the coated conductive wires S1 to S4 that are wound around the winding core portion 11*a* have a double-layered structure. At least the surfaces of the coated conductive wires S1 and S4 that are located in the first layer are covered with a resin coating layer 20. The resin coating layer 20 is made of an insulating resin material that is low in melting point, such as polyester, for example. The resin coating layer 20 may cover the coated conductive wires S2 and S3 that are located in the second layer. According to the present embodiment, particularly the upper surfaces U of the coated conductive wires S2 and S3 that are located in the second layer are partially covered due to a production method described later.

As shown in FIG. 4, the coated conductive wires S1 to S4 have the structure in which the core material (metal core) 31 is covered with a coating film (insulating film) 32. The resin coating layer 20 is provided in such a way as to cover the coating film 32 of the coated conductive wires S1 to S4. As for the coated conductive wires S1 and S4 that are located in the first layer, almost no area of the coating film 32 is exposed, and almost the entire area is covered with the resin coating layer 20.

In that manner, in the coil component 10 of the present embodiment, at least the coated conductive wires S1 and S4 that are located in the first layer are covered with the resin coating layer 20. Therefore, defective portions F of the coating film 32, such scratches and cracks, can be filled with the resin coating layer 20. Accordingly, it is possible to prevent a decline in dielectric strength voltage associated with the defective portions F, and to secure a high dielectric strength voltage.

The resin coating layer 20 exists only on the winding core portion 11*a* of the drum core 11. No resin coating layer 20 exists on the flange portions 11*b* and 11*c*. This means that no resin coating layer 20 exists between the flange portions 11*b* and 11*c* and the plate core 12, and that the wire connection portions E1 to E6 are not covered with the resin coating layer 20.

A manufacturing method of the coil component 10 according to the present embodiment will be described.

Figure 5:
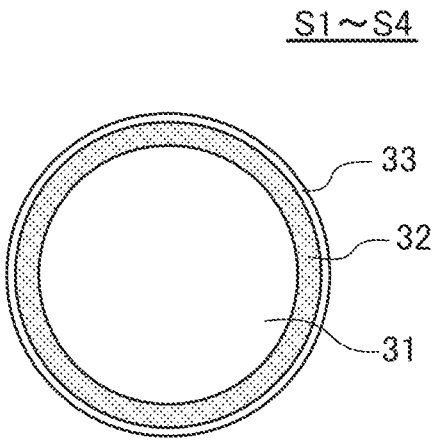
FIG. 5 is a cross-sectional view of coated conductive wires.

As shown in FIG. 5, the coated conductive wires S1 to S4 of a three-layer structure that includes the core material 31, the coating film 32, and a resin film 33 are prepared. The core material 31 is made of a good conductor such as copper (Cu), and the surface thereof is covered with the coating film 32. The coating film 32 is made of insulating material such as imide-modified polyurethane, and the surface thereof is covered with the thin resin film 33. The resin film 33 is made of insulating resin material such as polyester. The material of the resin film 33 is selected in such a way as to have a melting point that is sufficiently lower than that of the coating film 32. In one example, the melting point of imide-modified polyurethane is about 260 degrees Celsius, while the melting point of polyester is about 70 degrees Celsius.

Figure 6A:
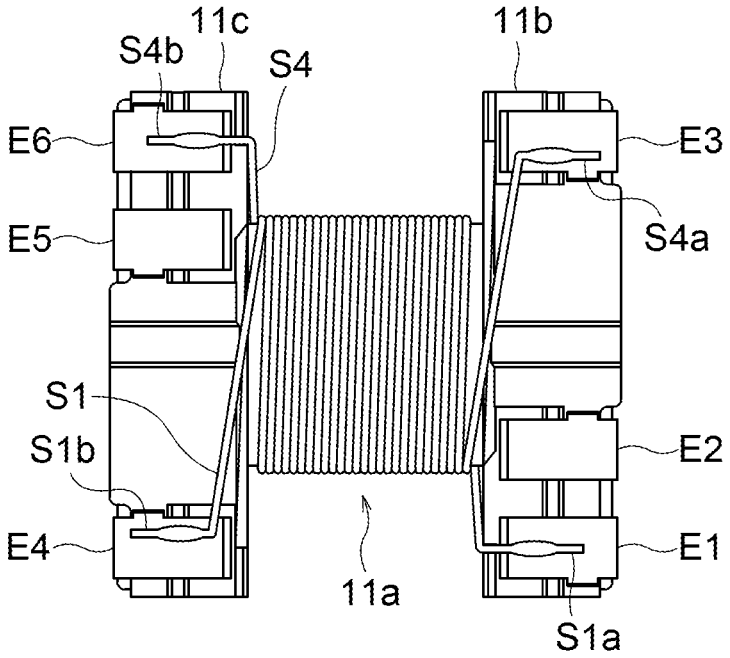
FIG. 6A is a schematic plan view indicating a state where two coated conductive wires are wound around a winding core portion in a first layer.

As shown in FIG. 6A, the coated conductive wires S1 and S4 are wound around the winding core portion 11*a* in a bifilar winding pattern, and both ends of each of the coated conductive wires S1 and S4 are connected to the corresponding wire connection portions E1, E3, E4, and E6 in order to form the first layer of the windings. More specifically, one ends S1*a* and S4*a* of the coated conductive wires S1 and S4 are connected by thermo-compression bonding or laser bonding to the wire connection portions E1 and E3, respectively. Then, the drum core 11 is rotated in one direction in order to wound the coated conductive wires S1 and S4 around the winding core portion 11*a*. After the rotation of the drum core 11 is stopped, the other ends S1*b* and S4*b* of the coated conductive wires S1 and S4 are connected by thermo-compression bonding or laser bonding to the wire connection portions E4 and E6, respectively. During this process, the heat generated by the thereto-compression bonding or laser bonding is conveyed via the core material 31. Accordingly, in portions close to the ends, the coating film 32 of the coated conductive wires S1 and S4 might be degraded, and defective portions, such as scratches or cracks, could emerge. Furthermore, due to mechanical stress that occurs at the time of winding, the coating film 32 could become defective. Moreover, when the thermo-compression bonding or laser bonding is carried out, the resin film 33 that exists at the one ends S1*a* and S4*a* of the coated conductive wires S1 and S4 and at the other ends S1*b* and S4*b* would change in quality due to the heat. According to the present invention, the resin that has changed in quality due to the heat at the time of wire connection is not part of the resin coating layer 20.

Figure 6B:
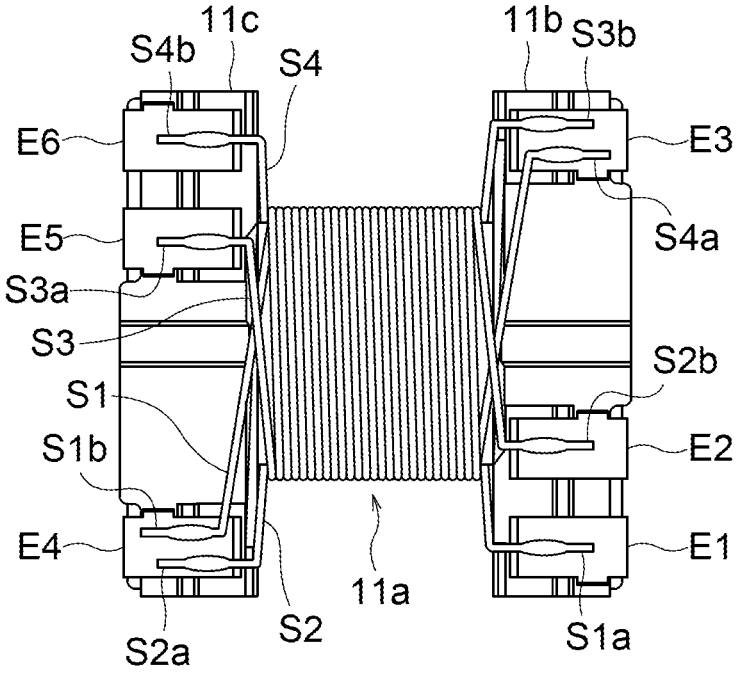
FIG. 6B is a schematic plan view indicating a state where another two coated conductive wires are further wound around the winding core portion in a second layer.

Then, as shown in FIG. 6B, the coated conductive wires S2 and S3 are wound around the winding core portion 11*a* in a bifilar winding pattern, and both ends of each of the coated conductive wires S2 and S3 are connected to the corresponding wire connection portions E2, E3, E4, and E5 in order to form the second layer of the windings. More specifically, the other ends S2*b* and S3*b* of the coated conductive wires S2 and S3 are connected by thermo-compression bonding or laser bonding to the wire connection portions E2 and E3, respectively. Then, the drum core 11 is rotated in the opposite direction in order to wound the coated conductive wires S2 and S3 around the winding core portion 11*a*. After the rotation of the drum core 11 is stopped, one ends S2*a* and S1*a* of the coated conductive wires S2 and S3 are connected by thermo-compression bonding or laser bonding to the wire connection portions E4 and E5, respectively. During this process, the resin film 33 that exists at the one ends S2*a* and S1*a* of the coated conductive wires S2 and S3 and at the other ends S2*b* and S3*b* would change in quality due to heat at the time of wire connection. Furthermore, the heat generated by the thermo-compression bonding or laser bonding is conveyed via the core material 31. Therefore, in portions close to the ends, the coating film 32 of the coated conductive wires S1 to S4 is degraded.

The coated conductive wires S1 and S4 suffer thermal damage twice, from the heat generated by the thereto-compression bonding or laser bonding during the formation of the first layer and from the heat generated by the thermo-compression bonding or laser bonding during the formation of the second layer. Therefore, the coating film 32 is likely to degrade. That is, the coated conductive wires S1 and S4 that constitute the first layer suffers greater damage than the coated conductive wires S2 and S3 that constitutes the second layer. Therefore, defective portions such as scratches or cracks are more likely to emerge in the coating film 32 of the coated conductive wires S1 and S4.

After the work to wind the coated conductive wires S1 to S4 is completed, the plate core 12 is bonded to the drum core 11. More specifically, a small amount of adhesive is applied to the flange portions 11*b* and 11*c* of the drum core 11. Then, the plate core 12 is placed on the flange portions 11*b* and 11*c* of the drum core 11. Then, thermal treatment is carried out to solidify the adhesive, and the plate core 12 is firmly fixed to the drum core 11 as a result. This thermal treatment is carried out at 150 degrees Celsius for about one hour, for example.

The resin film 33 that exists on the surfaces of the coated conductive wires S1 to S4 melts during the thermal treatment, and is infiltrated into gaps between the coated conductive wires S1 to S4. If defective portions F such as scratches or cracks exist on the coating film 32, the defective portions F are filled with the resin coating layer 20 which is the melted resin film 33. The resin coating layer 20 which is the melted resin film 33 gathers around the coated conductive wires S1 and S4 located in the first layer because of capillarity. Therefore, at least almost the entire area of the first layer is covered with the resin coating layer 20. On the other hand, mainly the upper surface U of the second layer may not be covered with the resin coating layer 20, and the coating film 32 is sometimes being exposed. Incidentally, the resin film 33 that exists in the wire connection portions E1 to E6 has changed in quality due to the heat at the time of wire connection. The resin film 33 therefore does not melt during the thermal treatment.

Through the steps described above, the coil component 10 of the present embodiment is completed.

As described above, according to the present embodiment, the coated conductive wires S1 to S4 whose surface is covered with the resin film 33 are used. Then, thermal treatment is carried out so that the resin film 33 melts. In this manner, the resin coating layer 20 is formed. As a result, at least the surfaces of the coated conductive wires S1 and S4 that are located in the first layer are automatically covered with the resin coating layer 20. As described above, the coated conductive wires S1 and S4 that are located in the first layer suffer thermal damage twice, and defective portions F are likely to emerge in the coating film 32. However, according to the present embodiment, the surfaces of the coated conductive wires S1 and S4 that are located in the first layer are automatically covered with the resin coating layer 20. Therefore, it is possible to ensure that defective portions F that emerge in the first-layer coating film 32 are filled with the resin coating layer 20. Even if defective portions F emerge in the coating film 32, it is possible to secure a sufficient dielectric strength voltage.

Another possible method is to coat with the resin material after the coated conductive wires S1 to S4 are wound around the winding core portion 11*a* in order to improve the dielectric strength voltage. However, if the viscosity of the resin material is high, the coated conductive wires S1 to S4 cannot be sufficiently coated. If the viscosity of the resin material is low, the resin material can get into the flange portions 11*b* and 11*c* of the drum core 11 because of capillarity. Particularly in the case of a coil component that is low in height with a small difference in height between the winding core portion 11*a* and the flange portions 11*b* and 11*c*, the inflow of the resin material inevitably occurs due to capillarity.

If the resin material flows to the lower surfaces of the flange portions 11*b* and 11*c*, the flow of the resin material creates a gap between the flange portions 11*b* and 11*c* and the plate core 12, resulting in a decrease in magnetic properties. If the resin material flows to the upper surfaces 11*bs* and lies of the flange portions 11*b* and 11*c*, the wire connection portions E1 to E6 that are terminal electrodes may be partially covered with the resin material, leading to a decrease in solder wettability at the time of implementation.

According to the present embodiment, the coated conductive wires S1 to S4 that are wound are not coated later with the resin material. The winding work is performed with the use of the coated conductive wires S1 to S4 on the surfaces of which the resin film 33 is provided in advance. After that, the resin film 33 is melted to form the resin coating layer 20, thereby eliminating the risk that the resin material could flow into the flange portions 11*b* and 11*c*. Furthermore, it is possible to ensure that the resin coating layer 20 covers the first layer constituted of the coated conductive wires S1 and S4 in which defective portions F are more likely to occur.

As described above, in the coil component 10 of the present embodiment, at least the coated conductive wires S1 and S4 that are located in the first layer are covered with the resin coating layer 20. Even if the coated conductive wires that are thin in diameter are used, it is possible to secure a sufficient dielectric strength voltage. Moreover, the resin coating layer 20 does not reach the flange portions 11*b* and 11*c*. Therefore, it is possible to prevent a decrease in magnetic properties and a drop in solder wettability.

Figure 7:
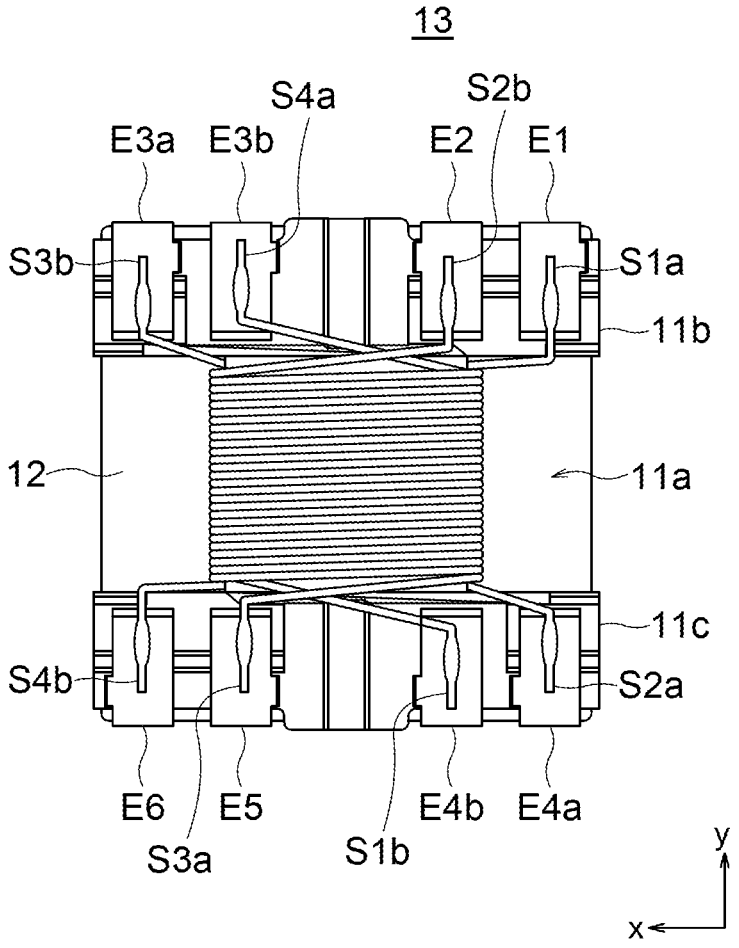
FIG. 7 is a schematic plan view showing the configuration of a coil component according to a second embodiment of the present invention.

FIG. 7 is a schematic plan view showing the configuration of a coil component 13 according to the second embodiment of the present invention, showing the configuration of a bottom surface side.

As shown in FIG. 7, the coil component 13 of the second embodiment is characterized in that the number of wire connection portions provided in each of the flange portions 11*b* and 11*c* is not 3 but 4. In the flange portion 11*b*, four wire connection portions E1, E2, E3*a*, and E3*b* are provided. In the flange portion 11*c*, four wire connection portions E4*a*, E4*b*, E5, and E6 are provided. An electrical connection between the other end S1*b* of the coated conductive wire S1 and one end S2*a* of the coated conductive wire S2 is achieved by a wiring pattern or land pattern on a printed circuit board at a time when the coil component 13 is mounted. Similarly, an electrical connection between the other end S3*b* of the coated conductive wire S3 and one end S4*a* of the coated conductive wire S4 is achieved by a wiring pattern or land pattern on a printed circuit board at a time when the coil component 13 is mounted. The rest of the configuration is the same as that of the coil component 10 of the first embodiment. Therefore, the same components will be represented by the same reference symbols, and will not be described again.

In that manner, in the coil component 13 of the present embodiment, the two wire connection portions E3*a* and E3*b* are short-circuited on the printed circuit board. Furthermore, the two wire connection portions E4*a* and E4*b* are short-circuited on the printed circuit board. Accordingly, it is possible to realize the same structure as that of the coil component 10 of the first embodiment. Thus, it is possible to achieve the same operation and advantageous effects as the first embodiment.

Figure 8:
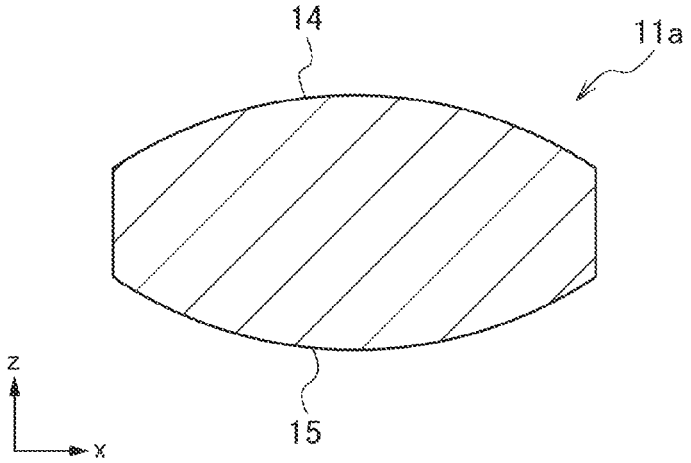
FIG. 8 is a cross-sectional view showing one example of an xz cross-section of a winding core portion of a drum core.

FIG. 8 is a cross-sectional view showing one example of an xz cross-section of a winding core portion 11*a* of a drum core 11.

In the example shown in FIG. 8, an upper surface 14 and lower surface 15 of the winding core portion 11*a* are arc-shaped. If the winding core portion 11*a* that has such an arc-shaped cross-section is used, the melted resin film 33 is infiltrated into the corners of the winding core portion 11*a* more easily than when a winding core portion 11*a* that is rectangular in cross-section is used. As a result, it is possible to ensure that the resin coating layer 20 covers the coated conductive wires S1 and S4 that are located at the corners of the winding core portion 11*a*. If the winding core portion 11*a* is elliptical or circular in cross-section, there are no corners. Therefore, it is possible to ensure that the resin coating layer 20 covers the coated conductive wires S1 and S4.

It is apparent that the present invention is not limited to the above embodiments, but may be modified and changed without departing from the scope and spirit of the invention.

For example, according to the above embodiments, the coated conductive wires that are wound around the winding core portion constitute a double-layered structure. However, the coil component of the present invention is not limited to this.

What is claimed is:

1. A coil component comprising:

a drum core that includes:

a first flange portion having a first inner wall;

a second flange portion having a second inner wall; and a winding core portion located between the first inner wall of the first flange portion and the second inner wall of the second flange portion;

a first wire connection portion formed on the first flange;

a second wire connection portion formed on the second flange;

a coated conductive wire that is wound around the winding core portion, the coated conductive wire having one end connected to the wire connection portion and an other end connected to the second wire connection portion, the coated conductive wire forming at least a first layer wound on the winding core portion and a second layer wound on the first layer; and a resin coating layer that covers the first and second layers of the coated conductive wire, wherein the resin coating layer formed on the second layer of the coated conductive wire is apart from the first and second inner walls so as to form gaps between the resin coating layer and the first and second inner walls.

2. The coil component as claimed in claim 1, wherein the coated conductive wire includes a primary winding and secondary winding that are insulated from each other.

3. The coil component as claimed in claim 1, further comprising a plate core that is bonded to the first and second flange portions.

4. The coil component as claimed in claim 3, wherein a gap between the plate core and the first and second flange portions is free from the resin coating layer.

5. The coil component as claimed in claim 1, wherein the first and second wire connection portions are free from the resin coating layer.

6. The coil component as claimed in claim 1, wherein at least part of a cross section of the winding core portion that is perpendicular to an axis direction is arc-shaped.

7. The coil component as claimed in claim 6, wherein the cross section of the winding core portion has first and second sides, the first side being arc-shaped and the second side being linear-shaped.

8. The coil component as claimed in claim 1, wherein the coated conductive wire includes a core material and a coating film covering the core material, and wherein a melting point of the resin coating layer is lower than that of the coating film.

9. The coil component as claimed in claim 8, wherein the resin coating layer comprises a polyester.

10. The coil component as claimed in claim 1, wherein at least a part of the winding core portion is exposed without being covered by the resin coating layer.

11. The coil component as claimed in claim 1, wherein at least a part of the second layer of the coated conductive wire is exposed without being covered by the resin coating layer.

12. The coil component as claimed in claim 1, wherein the resin coating layer formed on the first layer of the coated conductive wire is thicker than the resin coating layer formed on the second layer of the coated conductive wire.

* * * * *